US007361385B2

(12) United States Patent
Kabeya et al.

(10) Patent No.: US 7,361,385 B2
(45) Date of Patent: Apr. 22, 2008

(54) METHOD FOR MANUFACTURING HOT-DIP PLATED METAL STRIP AND APPARATUS FOR MANUFACTURING THE SAME

(75) Inventors: Kazuhisa Kabeya, Machida (JP); Kyohei Ishida, Kawasaki (JP); Munehiro Ishioka, Fukuyama (JP); Hideyuki Takahashi, Fukuyama (JP); Toshio Ishii, Fukuyama (JP); Yoichi Miyakawa, Kasaoka (JP); Akira Gamou, Fukuyama (JP); Yoshikazu Suzuki, Fukuyama (JP)

(73) Assignee: NKK Corporation, Tokyo (JP)

( * ) Notice: Subject to any disclaimer, the term of this patent is extended or adjusted under 35 U.S.C. 154(b) by 1245 days.

(21) Appl. No.: 10/289,793

(22) Filed: Nov. 7, 2002

(65) Prior Publication Data

US 2003/0077397 A1 Apr. 24, 2003

Related U.S. Application Data

(63) Continuation of application No. PCT/JP02/02347, filed on Mar. 13, 2002.

(30) Foreign Application Priority Data

Mar. 15, 2001 (JP) ..... 2001-074510
Dec. 26, 2001 (JP) ..... 2001-395253
Dec. 27, 2001 (JP) ..... 2001-396575

(51) Int. Cl.
*B05D 1/18* (2006.01)

(52) U.S. Cl. ..... 427/431; 427/433; 427/434.2; 427/434.4; 427/434.5; 427/436; 427/443.2

(58) Field of Classification Search ..... 427/598, 427/431, 433, 434.2, 434.4, 434.5, 436, 443.2
See application file for complete search history.

(56) References Cited

U.S. PATENT DOCUMENTS 5,049,453 A * 9/1991 Suemitsu et al. ..... 428/629
5,384,166 A * 1/1995 Sato et al. ..... 427/547
6,242,048 B1 * 6/2001 Iida et al. ..... 427/433

FOREIGN PATENT DOCUMENTS

JP 3-277754 A 12/1991
JP 4-168253 A 6/1992
JP 4-272162 A 9/1992

(Continued)

*Primary Examiner*—Bret B. Chen
(74) *Attorney, Agent, or Firm*—Frishauf, Holtz, Goodman & Chick, P.C.

(57) ABSTRACT

The invention relates to a method for manufacturing a hot-dip plated metal strip comprising the steps of: introducing a metal strip into a molten metal bath of plating metal to adhere the molten metal onto the surface of the metal strip; taking out the metal strip, after turning the running direction of the metal strip, from the molten metal bath without applying external force from outside the surface of the metal strip; adjusting the plating weight of the molten metal adhered onto the metal strip; and controlling the shape of the metal strip using magnetic force in non-contact state directly before or after the step of adjusting the coating weight. The invention prevents adhesion of dross to the metal strip without degrading the productivity, and thus manufactures a high quality hot-dip plated metal strip.

18 Claims, 13 Drawing Sheets

FOREIGN PATENT DOCUMENTS

| | | | | |
|---|---|---|---|---|
| JP | 04-272162 | A | * | 9/1992 |
| JP | 5-9690 | A | | 1/1993 |
| JP | 6-212380 | A | | 8/1994 |
| JP | 6-264205 | A | | 9/1994 |
| JP | 06-336669 | A | * | 12/1994 |
| JP | 6-336669 | A | | 12/1994 |
| JP | 7-48661 | A | | 2/1995 |
| JP | 07-102354 | A | | 4/1995 |
| JP | 7-188885 | A | | 7/1995 |
| JP | 7-268578 | A | | 10/1995 |
| JP | 07-268578 | A | * | 10/1995 |
| JP | 7-277559 | A | | 10/1995 |
| JP | 09-143652 | A | * | 6/1997 |
| JP | 11-100651 | A | * | 4/1999 |
| JP | 2000-345310 | A | | 12/2000 |

* cited by examiner

10:Position sensor
11:Controller
12:Amplifier
13:Electromagnet

METHOD FOR MANUFACTURING HOT-DIP PLATED METAL STRIP AND APPARATUS FOR MANUFACTURING THE SAME

This application is a continuation application of International Application PCT/JP02/02347 (not published in English) filed Mar. 13, 2002.

BACKGROUND OF THE INVENTION

1. Field of the Invention

The present invention relates to a method for manufacturing a hot-dip plated metal strip and an apparatus for manufacturing thereof.

2. Description of Related Arts

Hot-dip plating is a known method of continuous plating for a metal strip such as steel strip, which hot-dip plating method conducts metal strip plating by immersing the metal strip in a bath of molten metal of plating metal such as zinc and aluminum, (hereinafter referred to simply as "molten metal bath"). The hot-dip plating method has many advantages such as allowing manufacturing a plated steel strip at low cost compared with an electroplating method and allowing easily manufacturing a plated metal strip with thick coating layer.

FIG. 1 shows a conventional manufacturing line of hot-dip plated metal strip.

The metal strip 1 which was rolled in the preceding step of cold-rolling and was cleaned on the surface thereof in the succeeding cleaning step is transferred to a hot-dip plated metal strip manufacturing line, where the surface oxide film is removed and the metal strip is annealed in an annealing furnace 71 which is maintained in non-oxidizing or reducing atmosphere. Then, the metal strip 1 is cooled to a temperature almost equal with the temperature of a molten metal bath 2, and is introduced to the molten metal bath 2, where the molten metal is adhered onto the surface of the metal strip 1. After that, the metal strip 1 is taken out from the molten metal bath 2, and a gas ejected from a gas wiper 6 removes excess amount of molten metal adhered to the metal strip 1 to adjust the plating weight of the molten metal, thus to form the plating layer of the molten metal onto the metal strip 1.

As shown in FIG. 2, the metal strip 1 is introduced to the molten metal bath 2 via a cylinder 4 called "snout" which is kept to a non-oxidizing atmosphere therein, and the metal strip 1 is turned the running direction in the molten metal bath 2 by a sink roll 3 therein. Before being taken out from the molten metal bath 2, the metal strip 1 is corrected in the warp generated in width direction thereof and suppressed in the vibration thereof by a stabilizing roll 79*a* and a correct roll 79*b*, (both rolls are collectively called "submersed support rolls 79").

The metal strip 1 coated with a plating layer is subjected to various treatments depending on the uses thereof to become a final product. For example, when the metal strip 1 is used as an external panel of automobile, the metal strip 1 is subjected to alloying treatment of plating layer in an alloying furnace 9, and is introduced to a quenching zone 75, then is subjected to special rust-preventive and corrosion-preventive treatment in a conversion treatment unit 76.

The hot-dip plating method, however, has problems described below.

1) An impurity called "dross" is generated in the molten metal bath 2, which dross adheres to the metal strip 1 and to the submersed support rolls 79 to become a defect of the metal strip 1 reducing the yield thereof. To this point, high grade hot-dip plated metal strip used in, for example, an automobile external panel is processed at a low speed operation to prevent the adhesion of dross. The countermeasure, however, significantly degrades the productivity.

2) Since the submersed support rolls 79 are exposed to severe environment of high temperatures, troubles such as insufficient rotation likely occur, so that regular shut down of the line is requested for maintenance and replacement of the rolls, which degrades the productivity. In addition, these troubles may cause defects such as dross adhesion to the metal strip 1.

3) Owing to irregular rotational speed of the submersed support rolls 79, irregular plating weight occurs to induce chatter marks, which degrades the product quality.

SUMMARY OF THE INVENTION

An object of the present invention is to provide a method and an apparatus for manufacturing high quality hot-dip plated metal strip, allowing to prevent adhesion of dross without degrading the productivity.

The object is attained by a method for manufacturing a hot-dip plated metal strip, the method comprising the steps of: introducing a metal strip into a molten metal bath of plating metal to adhere the molten metal onto a surface of the metal strip; taking out the metal strip, after turning the running direction thereof, from the molten metal bath without applying external force from outside the surface of the metal strip; adjusting the plating weight of the molten metal adhered onto the metal strip; and controlling a shape of the metal strip using magnetic force in non-contact state directly before or after the step of adjusting the plating weight.

The method is realized by an apparatus for manufacturing a hot-dip plated metal strip, the apparatus comprising: a molten metal bath containing a molten metal of plating metal and having a unit for turning the running direction of the metal strip as sole unit for applying external force thereto from outside the surface of the metal strip; a wiper for adjusting the plating weight of the molten metal adhered onto the metal strip; and a control unit positioned directly before or after the wiper to control the shape of the metal strip using an electromagnet in non-contact state.

DETAILED DESCRIPTION OF THE INVENTION

The inventors studied the method for manufacturing a high quality hot-dip plated metal strip that allowed to prevent adhesion of dross without degrading the productivity, and found that the removal of submersed support rolls and the control of the shape of metal strip at a position of leaving the metal strip from the molten metal bath in a non-contact state were extremely effective. The detail of the method is described in the following.

Figure 3:
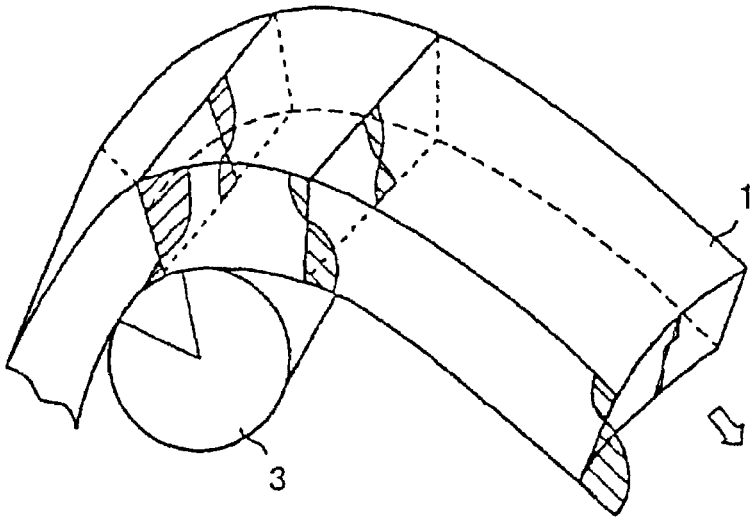
FIG. 3 illustrates a mechanism of generating warp of metal strip in the width direction thereof.

FIG. 3 illustrates a mechanism of generating warp on the metal strip in the width direction thereof.

The warp of metal strip 1 in the width direction thereof is presumably generated when the metal strip 1 is subjected to bending and unbending mainly on the sink roll 3. That is, the metal strip 1 is bent by being wound around the sink roll 3, then is unbent by the sink roll 3 at a moment immediately before leaving the sink roll 3. Thus, the metal strip 1 receives tensile stress on the face thereof contacting the sink roll 3, and receives compression stress on the opposite face thereof. Accordingly, at a position where the metal strip 1 leaves the sink roll 3 to vanish the restriction force therefrom, the face of the metal strip 1 contacting the sink roll 3 becomes free from the tensile stress and is subjected to a force to return to original state, while the opposite face of the metal strip 1 becomes free from the compression stress and is subjected to a force to return to original state. As a result, the metal strip 1 is subjected to the resulting stress distribution to induce warp in the width direction thereof to bend on both edges thereof toward the sink roll 3.

When a warp is generated on the metal strip in that manner, the gas wiper cannot perform the adjustment of coating weight uniformly in the width direction of the metal strip 1 after leaving the molten metal bath, thus inducing irregular plating weight in the width direction of the metal strip.

When a warp is generated on the metal strip, there appears a limitation in shortening the distance between the metal strip and the gas wiper to avoid the contact between the metal strip and the wiper. As a result, the wiping-gas pressure has to be increased to assure a specified removal performance of molten metal, which may induce a defect called "splash" (a phenomenon that vigorously splashed molten metal during wiping action adheres to the metal strip).

Consequently, the warp generated on the metal strip at the sink roll has to be corrected by submersed support rolls.

Figure 4:
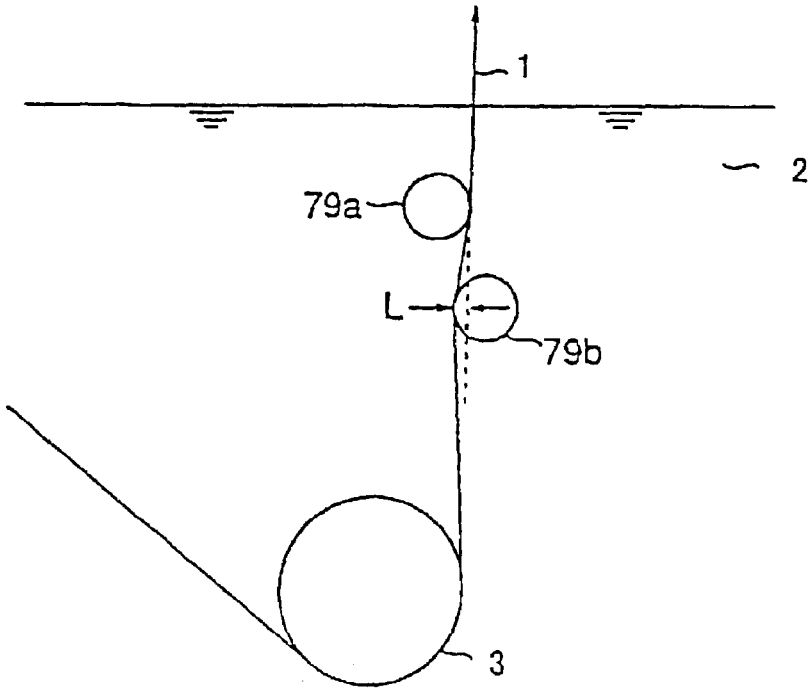
FIG. 4 illustrates a mechanism of correcting warp of metal strip using submersed support rolls.

FIG. 4 illustrates a mechanism of correcting warp of metal strip using submersed support rolls.

The submersed support rolls consist of the stabilizing roll 79*a* and the correct roll 79*b* which is positioned below the stabilizing roll 79*a* and is movable in horizontal direction. The metal strip 1 is turned the running direction thereof by the sink roll 3 upward in the molten metal bath 2. The stabilizing roll 79*a* is positioned to contact with the metal strip 1 which is turned the running direction upward. The correct roll 79*b* is positioned so as the metal strip 1 between the sink roll 3 and the stabilizing roll 79*a* to be pushed in the normal direction to the metal strip 1 by a specified distance L.

As described above, a warp is generated on the metal strip 1 caused by bending and unbending induced by the sink roll 3. If, however, the correct roll 79*b* is used to adequately adjust the distance L, a reverse directional bend is applied to the metal strip 1 to correct the warp.

Generally, vibration on the metal strip is generated caused by the unstable roll rotational frequency component induced by incorrect rotation and looseness of sink roll and other disturbance, and caused by excitation of natural frequency mode of the metal strip itself.

Figure 1:
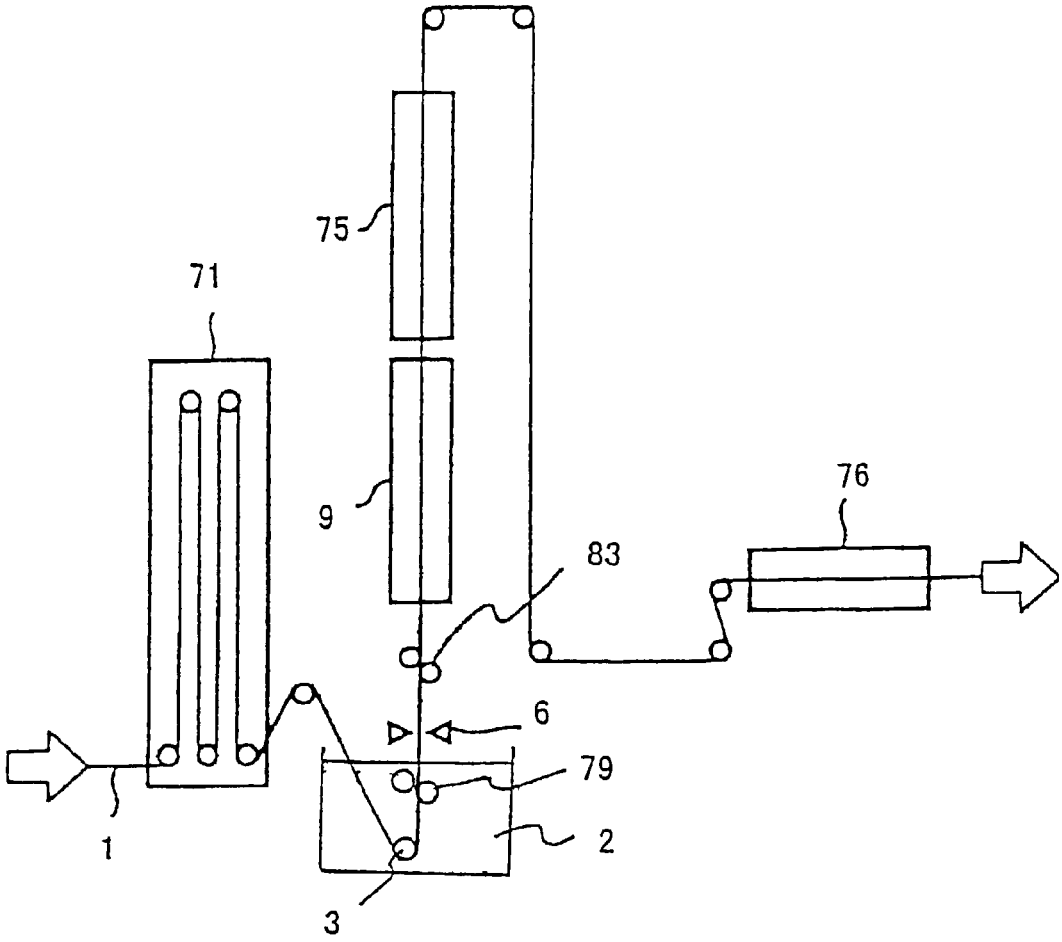
FIG. 1 illustrates a conventional manufacturing line of hot-dip plated metal strip.

As illustrated in FIG. 1, the conventional manufacturing line of hot-dip plated metal strip very likely induces vibration because the metal strip 1 is taken up from the molten metal bath for a distance of several tens of meters without any support thereto.

Figure 2:
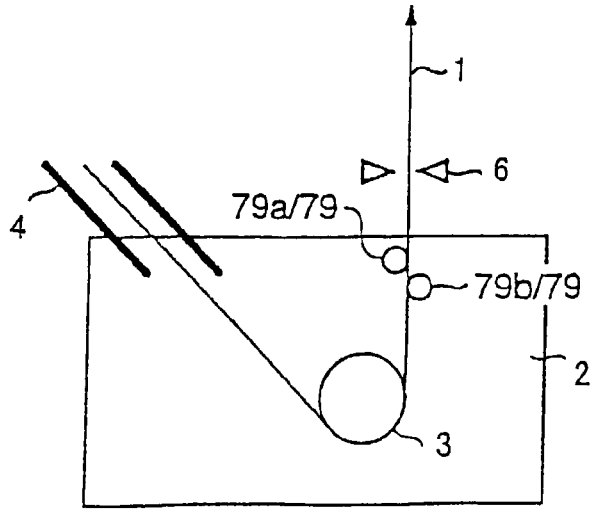
FIG. 2 illustrates a conventional molten metal bath.

To this point, by restricting the metal strip 1 between the submersed support rolls 79, as illustrated in FIG. 2, the vibration is suppressed. For the case of FIG. 2, since the submersed support rolls 79 create a node of vibration, the effect of suppression of vibration at far above the molten metal bath 2 cannot be expected. However, the suppression of vibration at the point of gas wiper 6, near the submersed support rolls 79, is expected, so the irregularity in plating weight, which is the most important variable in quality, can be reduced.

Thus, the submersed support rolls have long been applied to correct the warp in the width direction of the metal strip and to suppress the vibration of the metal strip, and, owing to the field effects, the support rolls are accepted as an essential device in the manufacturing line of hot-dip plated metal strip.

Nevertheless, the use of submersed support rolls raises several problems described below.

① Impurities such as dross generated in molten metal bath adhere to the metal strip. The submersed support rolls press the impurities against the surface of the metal strip to induce defects such as flaws.

② When the correct roll is strongly pressed against the metal strip for correcting warp in the width direction of the metal strip, a defect called "break mark" is generated on the metal strip.

③ Owing to the incorrect rotation or looseness of the submersed support rolls themselves, the metal strip vibrates at the gas wiper position to generate roll mark, which is a stripe pattern defect, on the metal strip.

④ To conduct regular maintenance and replacement of the submersed support rolls, the facility is required to shut-down, which degrades the productivity and needs the maintenance cost.

Since these problems do not occur if the submersed support rolls are absent, the inventors studied the elimination of submersed support rolls in the hot-dip molten metal bath.

First, the inventors of the present invention studied the influence of the elimination of submersed support rolls on the quality of metal strip. In actual manufacturing, it is said that the submersed support rolls have a function to prevent adhesion of foreign matter such as dross in the molten metal bath to the metal strip. Therefore, the elimination of the submersed support rolls might increase the defects on the metal strip.

Figure 5:
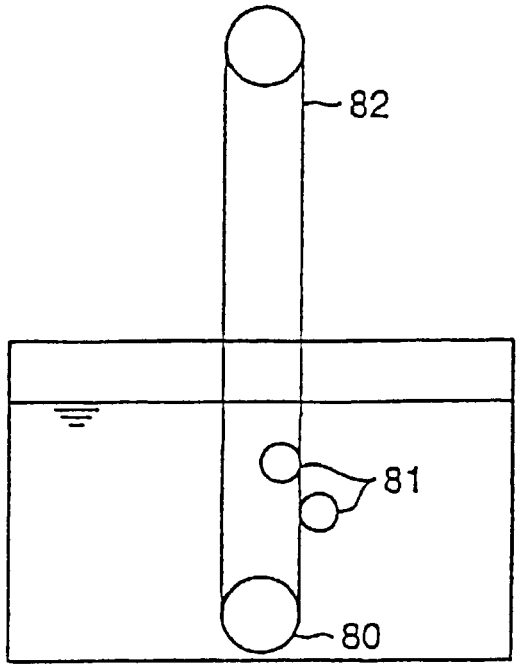
FIG. 5 illustrates an experimental apparatus for investigating the effect of the submersed support rolls on the quality of metal strip.

FIG. 5 illustrates an experimental apparatus for investigating the effect of the submersed support rolls on the quality of metal strip.

The experimental apparatus adopts water instead of molten metal. A roll 80 and rolls 81 are placed in the water as a sink roll and support rolls, respectively. An endless belt 82 is used as the metal strip. Although water is adopted instead of the molten metal, the roll diameter and the roll rotational speed are selected to simulate the actual fluid dynamics behavior in the molten metal bath in terms of Reynolds number and Froude number around the rolls in the molten metal bath. Aluminum powder is added to the water as a tracer to observe the flow of water.

Figure 6:
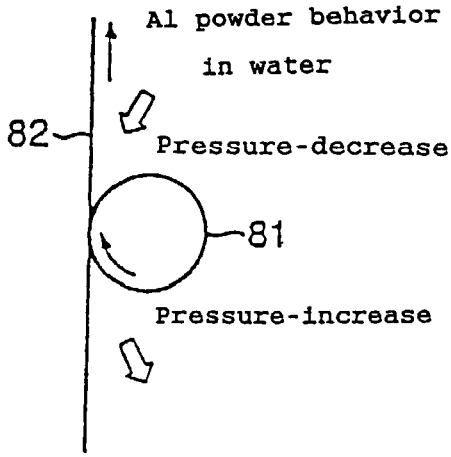
FIG. 6 illustrates a flow pattern of water in the vicinity of a support roll.

FIG. 6 illustrates a flow pattern of water in the vicinity of a support roll.

At a region beneath the contact point of the support roll 81 and the belt 82, there was observed a phenomenon that the discharge flow caused by the pressure-increase pushes out the foreign matter. On the other hand, at a region above the contact point of the support roll 81 and the belt 82, a suction flow caused by the pressure-decrease appeared to create a condition likely allowing adhesion of foreign matter.

No action of removing foreign matter once adhered to the belt 82 was observed on the support rolls 81, and the support rolls 81 only acted to press the foreign matter against the belt 82.

From thus observed result, the inventors concluded that the submersed support rolls have no function for removing foreign matter and that no increase in defects occurs even if the submersed support rolls are eliminated. Therefore, to eliminate the submersed support rolls, a means that can perform the function to correct the warp in the width direction of the metal strip and that can perform the function of suppressing vibration should be provided.

An expecting means to perform these functions is to place the submersed support rolls above the molten metal bath and to position them between the level of the bath and the wiper. The means, however, has problems described below.

1) The molten metal which is removed by the wiper is oxidized to become dross of, for example, ZnO and $Al_2O_3$, which dross is then pressed against the surface of metal strip by the support rolls positioned above the bath to cause defects.

2) Since the distance between the bath level and the wiper is generally about 400 to 500 mm, there is no space for mounting the support rolls.

In this regard, the inventors introduced the active control technology as a substitute means. The active control technology is a technology that uses an actuator to apply external force to the control target based on the state of the target determined by a sensor, thus making the shape of the target to a desired shape and suppressing the vibration of the target. The technology has shown wide applications owing to the drastic increase in the computer capacity. The technology did not exist at the time of developing conventional molten metal plating technology. To apply the technology to the shape correction and to the vibration suppression, the actuator may be controlled to place the condition of flattening and of avoiding vibration for the metal strip as the target condition. In that case, the actuator is required to be able to apply force in non-contact state for preventing defect generation on the metal strip. Examples of the actuator are magnetic force actuator (electromagnet) and pneumatic actuator (air pad).

For example, JP-A-7-102354, (the term "JP-A" referred herein signifies the "unexamined Japanese patent publication"), discloses a means for shape correction and for vibration suppression of metal strip using a static pressure pad (pneumatic actuator) which also functions as a gas ejection nozzle for adjusting the plating weight. The means, however, has problems such as: 1) use of pneumatic actuator positioned above the molten metal bath may raise a problem of quality because unnecessary cooling of the metal strip occurs caused by the gas flow; 2) compared with electromagnet, the pneumatic actuator is large, and needs wide space for installing accompanied piping and fan; and 3) compared with electromagnet, the pneumatic actuator consumes large electric power. According to the means disclosed in JP-A-7-102354, the running passage of the metal strip is in an arc shape. Consequently, if the gas ejection stops in case of power failure or the like, the metal strip may collide with the static pressure pad to induce serious line trouble. Therefore, the pneumatic actuator is not suitable, and the magnetic force actuator is required.

Thus, if the submersed support rolls are eliminated from the molten metal bath, if no external force is applied from outside the surface of the strip except for turning the running direction of the metal strip in the molten metal bath, and if the shape of the metal strip left from the molten metal bath is controlled by magnetic force in non-contact state in the vicinity of the wiper for adjusting plating weight, the adhesion of dross can be prevented without degrading the productivity, and the plating weight on the metal strip can be uniformized to manufacture high quality hot-dip plated steel strip.

Figure 7:
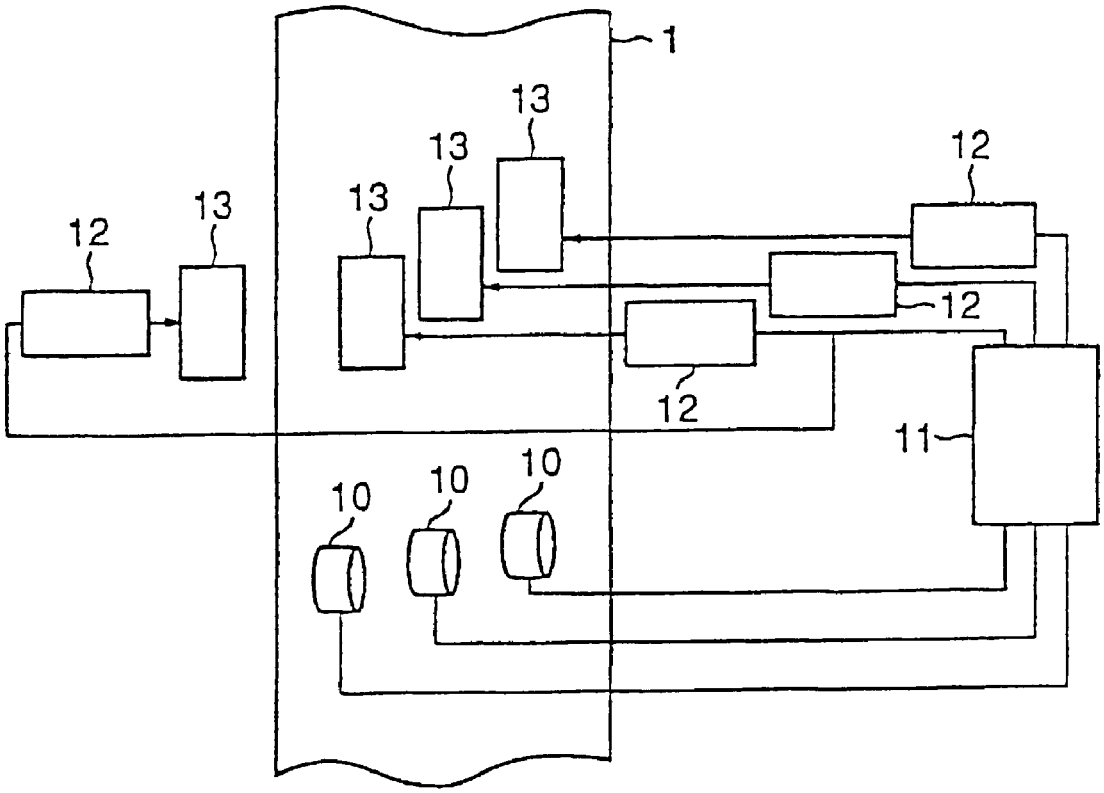
FIG. 7 shows an example of shape control method for metal strip using electromagnets.

FIG. 7 shows an example of shape control method for metal strip using electromagnets.

Along the surface of running metal strip 1, plurality of position sensors 10 that determine the distance from the surface of the metal strip 1 and plurality of electromagnets 13 that control the shape of the metal strip 1 are located in non-contact state. A controller 11 receives the signals sent from the position sensors 10, and transmits the control signals to the electromagnets 13 via amplifiers 12, thus correcting the warp of the metal strip 1 using the suction force of the electromagnets 13. Three sets of position sensor 10 and electromagnet 13, at both ends and center in the width direction of the metal strip 1, satisfactorily allow to correct the warp of the metal strip 1. The correction of warp is done to make the metal strip 1 flat at the position of the wiper. For example, if an electromagnet 13 is positioned directly after the wiper, it is effective that the electromagnet 13 applies a force so as the metal strip 1 to give a warp inverse to the original warp.

Simultaneous control of the shape and the vibration on the metal strip makes the plating weight of the molten metal more uniform.

After the adjustment of plating weight of molten metal on the metal strip, if rolls (support rolls outside the bath) are brought into contact with the metal strip to control the vibration, the vibration can be more surely prevented.

The metal strip after controlled the vibration by contacting with the rolls may further be subjected to alloying treatment for the plating layer.

The wiper for adjusting the plating weight may be an electromagnetic wiper or the like, other than the above-described gas wiper.

In the case that the submersed support rolls are eliminated and are substituted by a non-contact control means, the space in the molten metal bath can be utilized so that the optimization of the diameter of sink roll and of the position of sink roll can be established, as described below.

The maximum tensile stress σ generated in the uppermost layer of the surface of the metal strip wound around a roll under application of tension $\sigma_t$ is expressed by eq.(1)

$$\sigma = t \times E \times (\sigma_y + \sigma_t)/(D \times \sigma y) \quad (1)$$

where, t designates the thickness of metal strip, E designates the Young's modulus of metal strip, $\sigma_y$ is the yield stress of metal strip, and D designates the roll diameter.

If the stress σ becomes equal to or above the yield stress of the metal strip, the metal strip presumably generates plastic deformation, thus generating warp in the width direction thereof. Accordingly, larger roll diameter D is more difficult in inducing plastic deforming of the metal strip, resulting in smaller warp in the width direction of the metal strip.

Figure 8A:
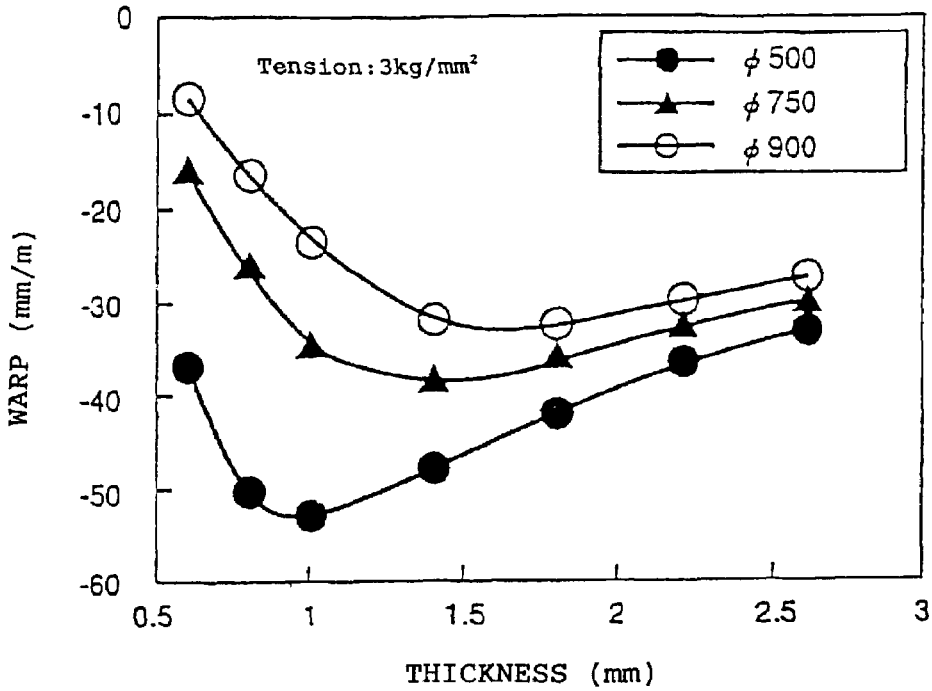
FIG. 8A and FIG. 8B are graphs showing the relationship between the warp, the thickness of metal strip, and the diameter of sink roll.
Figure 8B:
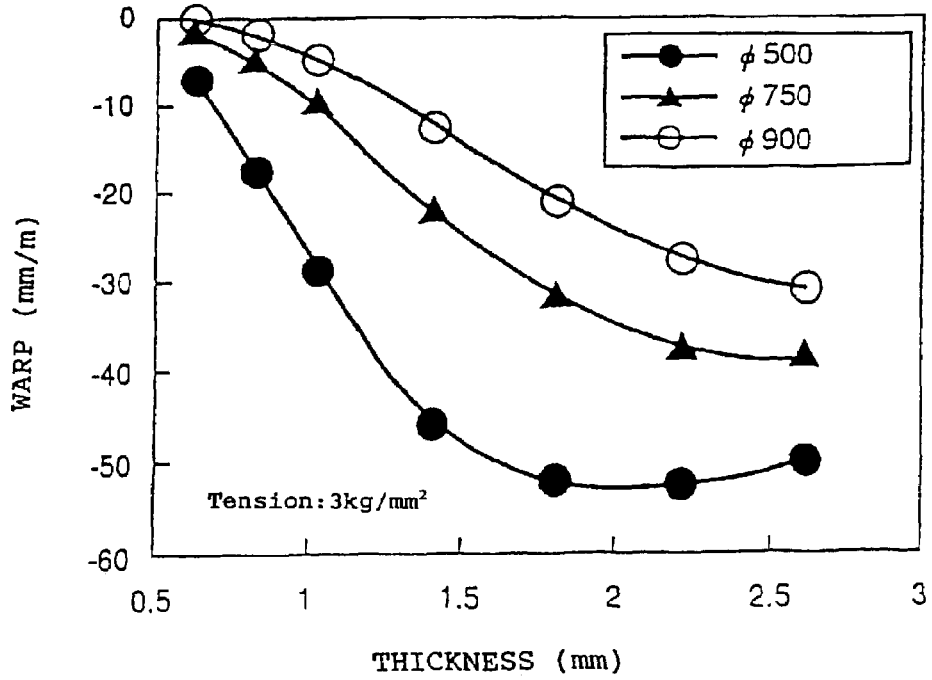

FIG. 8A and FIG. 8B are graphs showing the relationship between the warp, the thickness of metal strip, and the diameter of sink roll.

FIG. 8A and FIG. 8B give the relationship between the warp and the thickness of metal strip per 1 m width at a tension of 3 kg/mm$^2$ and each of the sink roll diameters of 500, 750, and 900 mm. FIG. 8A is for a metal strip having the yield stress of 8 kg/mm$^2$, and FIG. 8B is for a metal strip having the yield stress of 14 kg/mm$^2$.

The figures suggest that the maximum warp is around −53 mm for the sink roll diameter of 500 mm, around −38 mm for the sink roll diameter of 750 mm, and around −32 mm for the sink roll diameter of 900 mm. If the warp is as large as −53 mm, it is expected that, if no submersed support roll is applied, the warp correction becomes difficult unless the output of the electromagnet as the shape correction means is significantly increased.

Figure 9:
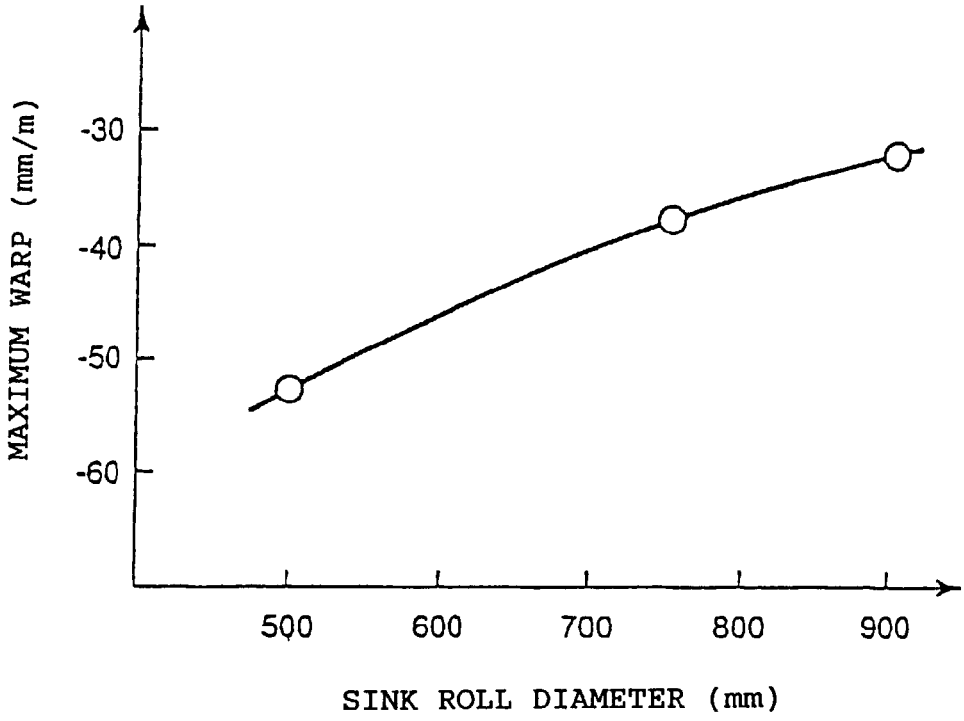
FIG. 9 is a graph showing the relationship between the diameter of sink roll and the maximum warp.

FIG. 9 is a graph showing the relationship between the diameter of sink roll and the maximum warp.

If the sink roll diameter is 600 mm or more, the maximum warp becomes around −46 mm or less, which allows reducing the warp using an ordinary electromagnet. If the sink roll diameter is 850 mm or more, the maximum warp becomes around −35 mm or less so that smaller output of electromagnet can fully correct the warp.

As for the vertical position of the sink roll in the molten metal bath, a preferable distance between the upper end of the sink roll and the level of the molten metal bath is between 50 and 400 mm. If the distance is less than 50 mm, the rotation of sink roll disturbs the surface of the molten metal bath, which makes the top dross consisting mainly of zinc oxide existing at near the surface of the bath easily adhere to the metal strip. If the distance exceeds 400 mm, the distance from next support point, for example a roll located between the wiper above the bath and the alloying furnace, or the distance from the support roll outside the bath, increases, which increases the vibration of metal strip, the warp at gas wiper section, and the quantity of carrying molten metal. More preferably, the distance is from 100 to 200 mm.

The distance between the lower end of sink roll and the bottom of the molten metal bath is preferably 400 mm or more from the point of prevention of dross adhesion. More preferably, the distance is 700 mm or more.

Dross which causes defects of a steel strip by adhering thereto during hot-dip galvanizing is the bottom dross existing near the bottom of the bath. The bottom dross is an intermetallic compound of zinc and iron which is eluted from the steel strip in the molten zinc bath. The dross in the initial stage of generation thereof is fine. The fine dross does not induce significant problem in quality even if it adheres to the steel strip. Since, however, the fine dross has higher density than zinc, it sediments in the molten zinc bath to deposit. Once deposited dross on the bottom of the molten zinc bath likely surfaces carried by a flow of molten zinc accompanied with the running steel strip. During repeated surfacing and sedimenting, the fine dross coagulates owing to the variations in bath temperature and to the variations in bath composition to become coarse dross. The coarse dross floats along with the flow of molten zinc, and likely induces defects of the steel strip by adhering to the surface thereof. Increase in the running speed of the steel strip increases the flow speed of the molten zinc, which enhances the surfacing of dross to increase the generation of defects on the steel strip.

Accordingly, to surely prevent the generation of defects on the steel strip, it is necessary to prevent surfacing of dross which sedimented to the bottom of the molten zinc bath. To do this, it is necessary to prevent significant influence of the running steel strip on the bottom portion of the molten zinc bath. Also it is necessary that, even if the dross surfaces, the floating dross does not adhere to the steel strip.

Figure 10:
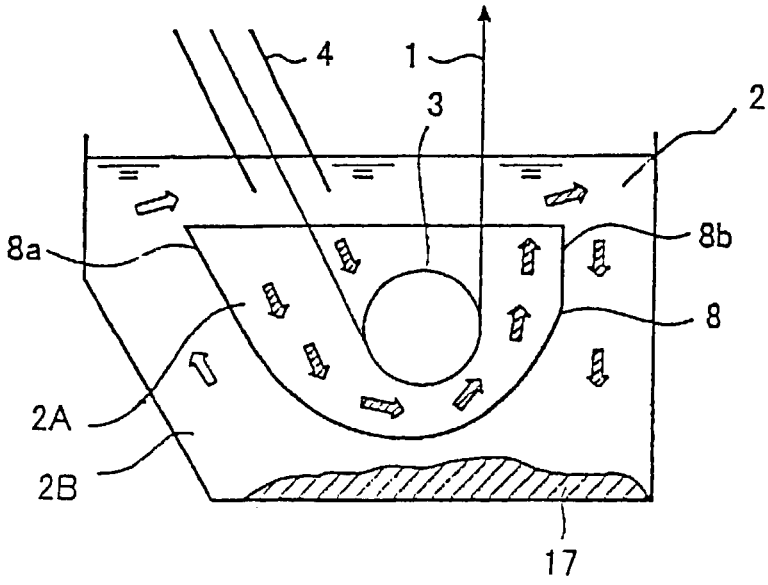
FIG. 10 illustrates an example of molten metal bath having an open top enclosure.

To this point, the inventors of the present invention found that it was effective to separate the molten metal bath 2 to upper and lower zones using an open top enclosure 8 which encloses the sink roll 3 from lower side thereof, and to allow the molten metal at above and beneath the open top enclosure 8 to flow therebetween, which is illustrated in FIG. 10. FIG. 10 does not show the side plates enclosing the sink roll 3 lateral to the axis of rotation thereof. According to the present invention, no submersed support roll is adopted, and thus there is much space in the molten metal bath 2, so that the open top enclosure 8 can be advantageously installed.

In a molten metal bath zone 2A above the open top enclosure 8, the molten metal flows in arrow direction carried by the running metal strip 1, and flows toward the zone beneath the open top enclosure 8 from the side where the metal strip 1 is taken out from the molten metal bath 2. In a molten metal bath zone 2B beneath the open top enclosure 8, the molten metal flows upward to above the open top enclosure 8 from the side where the metal strip 1 is introduced to the molten metal bath 2. Thus the molten metal forms a circulation flow.

If the metal strip 1 is a steel strip, and if the molten metal is zinc, Fe elutes from the steel strip 1 in the molten zinc bath zone 2A to form fine Fe—Zn base dross. A portion of the fine dross adheres to the steel strip 1 to leave the molten zinc bath zone 2A. Even when the fine dross adheres to the steel strip 1, it does not raise quality problem. The fine dross that was not removed from the molten zinc bath zone 2A is promptly discharged to the zone beneath the open top enclosure 8 along with the flow of molten zinc accompanied by the running steel strip 1 from the side where the steel strip 1 is taken out from the molten metal bath 2 in the open top enclosure 8.

The fine dross entered in the molten zinc bath zone 2B passes through the area beneath the open top enclosure 8, and moves to the side where the steel strip 1 is introduced to the molten metal bath 2 in the open top enclosure 8. The molten zinc bath zone 2B has larger capacity than the molten zinc bath zone 2A, and is free from direct influence of the flow of molten zinc accompanied with the running steel strip 1, so the flow of the molten zinc in the molten zinc bath zone 2B is mild. As a result, during a period of flowing the molten zinc entered in the molten zinc bath zone 2B to a snout 4, the dross existing in the molten zinc sediments to the bottom portion of the molten zinc bath zone 2B to deposit. The deposited dross grows to coarse dross 17. Since thus grown coarse dross 17 hardly surfaces even when the running speed of the steel strip 1 varied, the molten zinc which traveled through the molten zinc bath zone 2B and reached near the snout 4 is free of dross.

The molten zinc free of dross enters the molten zinc bath zone 2A from the top 8*a* of the side face of the open top enclosure 8 carried by the flow of molten zinc accompanied with the running steel strip 1.

Consequently, no coarse dross 17 adheres to the steel strip 1 during the period of from introducing the steel strip 1 into the molten metal bath 2 via the snout 4 to taking out from the molten zinc bath 2.

The method of adopting the open top enclosure 8 establishes the circulation flow of molten metal utilizing the flow of molten metal accompanied with the running steel strip 1, without need of additional driving means such as pump. Therefore, the method is a simple and low cost one.

The open top enclosure 8 may be made of, for example, stainless steel sheet.

As shown in FIG. 10, the open top enclosure 8 is preferably located beneath the level of the molten metal bath 2 for the top dross not to adhere to the side face of the open top enclosure 8. Alternatively, the open top enclosure 8 may be located in such a way that the top edge thereof is above the level of the molten metal bath. In that case, it is necessary that the side face of the open top enclosure 8 has an opening to allow the molten metal flowing therethrough.

In the case that the open top enclosure 8 is positioned below the level of the molten metal bath 2, if the depth of top of the open top enclosure 8 becomes less than 100 mm from the level of the molten metal bath 2, the flow of molten metal accompanied with the running steel strip 1 agitates the bath surface to increase the generation of top dross. Therefore, it is preferred that the top of the open top enclosure 8 is kept to 100 mm or larger depth from the level of the molten metal bath.

It is preferable that the minimum distance between the open top enclosure 8 and the sinkroll 3 is 50 to 400 mm. If the distance is less than 50 mm, the contact with thermally deformed metal strip 1 may occur, and the installation of the open top enclosure 8 becomes difficult. If the distance exceeds 400 mm, there appears a zone of no influence of the flow of molten metal accompanied with the running metal strip 1 in the open top enclosure 8, which fails to discharge the dross generated in the open top enclosure 8, and results in deposition of coarse dross in the molten metal bath zone 2A.

It is preferable that the top edges 8*a* and 8*b* of both sides of the open top enclosure 8 are so placed above the position of shaft center of the sink roll 3 that the flow of molten metal accompanied with the running metal strip 1 in the molten metal bath zone 2A does not affect the flow of the molten metal in the molten metal bath zone 2B, and that the coarse dross deposited in the bottom portion of the molten metal bath zone 2B does not surface. Furthermore, it is more preferable that the top edges 8*a* and 8*b* are above the top of sink roll 3.

It is preferable that the distance between the top 8*a* of the side of the open top enclosure 8 at the snout 4 side and the metal strip 1 is 1,000 mm or less. It is more preferable that the distance is 800 mm or less.

Figure 11:
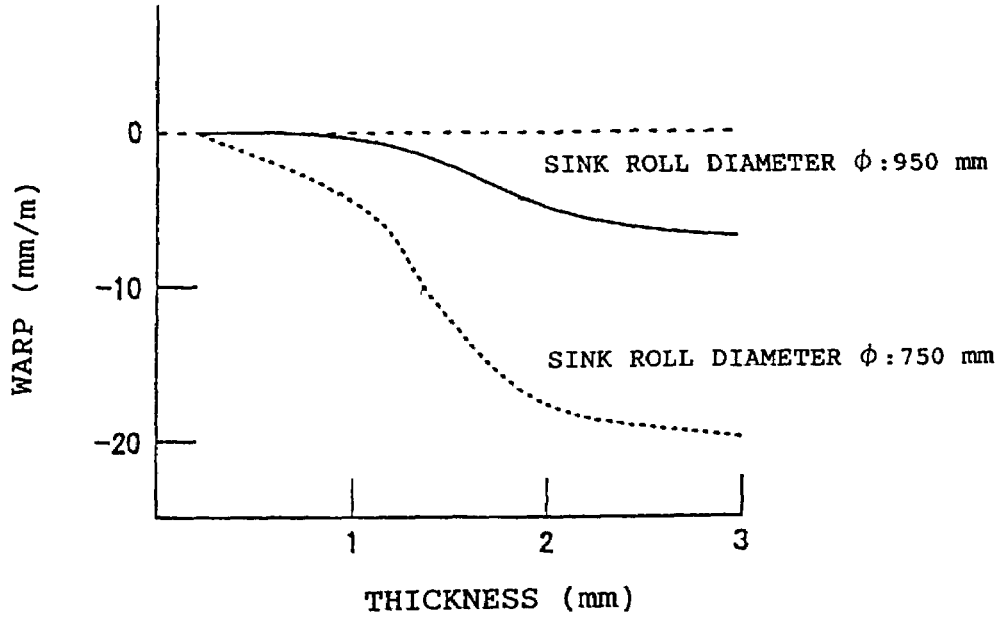
FIG. 11 is a graph showing the relationship between the warp, the thickness of metal strip, and the diameter of sink roll in the presence of an open top enclosure.

As shown in FIG. 11, even when the open top enclosure 8 exists, the relationship between the warp and the diameter of sink roll is the same as that of the above-described case without open top enclosure 8, and it is preferable that the diameter of sink roll is 850 mm or more.

The position of the sink roll is also preferably the one in the above-described case without open top enclosure 8.

As shown in FIG. 10, if the side face of the open top enclosure 8 at the side where the metal strip 1 is taken out from the molten metal bath 2 is almost in parallel with the surface of the metal strip 1, and if the top 8*b* of a side face of the open top enclosure 8 is positioned at above the top of sink roll 3, and at 100 mm or larger distance from the level of the molten metal bath 2, the flow of the molten metal accompanied with the running metal strip 1 can be kept at a high speed. As a result, the molten metal in the molten metal bath zone 2A is efficiently transferred to the molten metal bath zone 2B, and the adhesion of dross to the metal strip can be effectively prevented.

Figure 12:
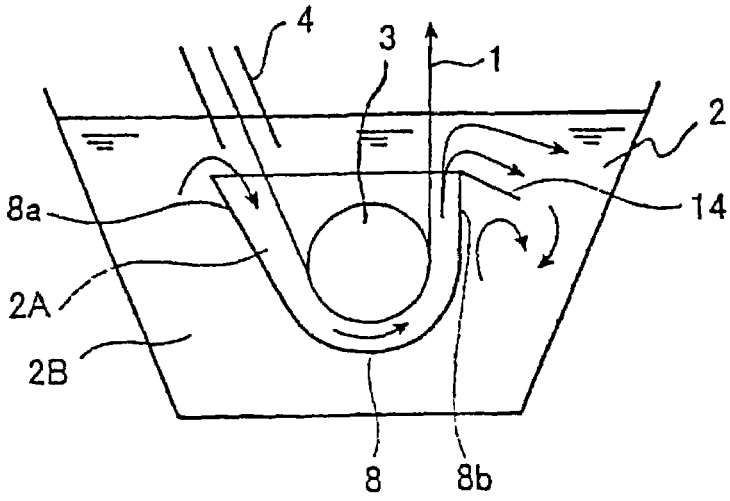
FIG. 12 illustrates an example of open top enclosure provided with a plate preventing dross from surfacing.

As illustrated in FIG. 12, if the plate preventing dross from surfacing 14 is located at the top 8*b* of a side face of the open top enclosure 8 facing outside the open top enclosure 8, the coarse dross deposited at the bottom portion of the molten metal bath zone 2B is prevented from surfacing carried by the molten metal entering from the molten metal bath zone 2A and from adhering to the metal strip 1. From the viewpoint of suppressing the disturbance of level of the molten metal bath 2, the plate preventing dross from surfacing 14 is preferably tilted downward from the horizon. The plate preventing dross from surfacing 14 may be located at the top 8*a* of another side face of the open top enclosure 8.

Figure 13:
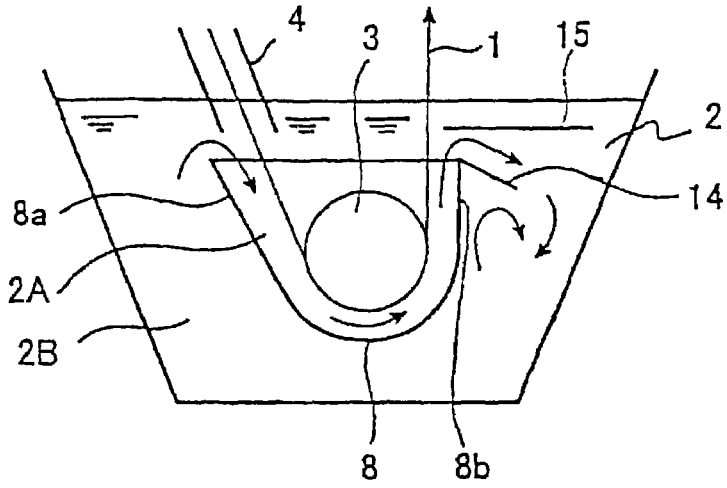
FIG. 13 illustrates an example of open top enclosure provided with a streaming plate.

As illustrated in FIG. 13, if a streaming plate 15 is located nearly in parallel with the bath level between the plate for preventing dross from surfacing 14 positioned at the top 8*b* of a side face of the open top enclosure 8 and the level of the molten metal bath 2, the molten metal left from the molten metal bath zone 2A easily flows into the molten metal bath zone 2B, and also the disturbance of the level of molten metal bath 2 caused by the flow of molten metal is prevented. It is preferred that the streaming plate 15 is positioned as near the metal strip 1 as possible for assuring smooth flow of molten metal. It is, however, necessary that the streaming plate 15 is distant from the metal strip 1 by 30 mm or more to avoid accidental contact with the metal strip 1.

Figure 14:
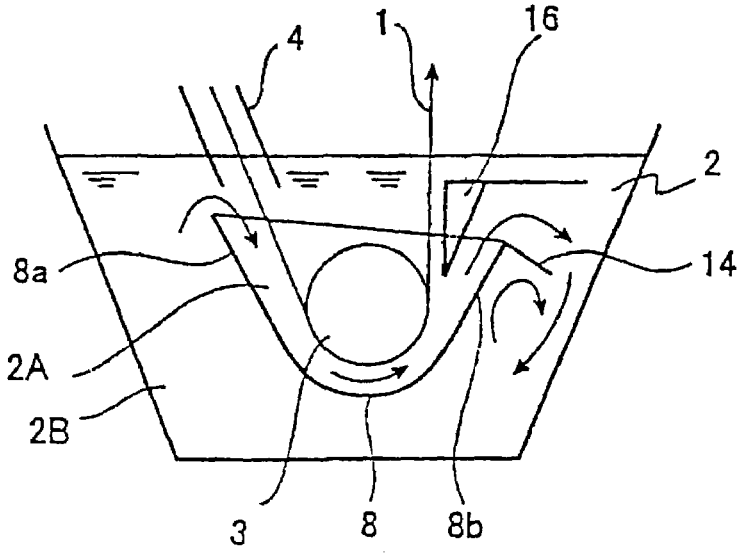
FIG. 14 illustrates another example of open top enclosure provided with another streaming plate.

FIG. 14 illustrates an example of the streaming plate 16, having another shape of the streaming plate from above. The streaming plate 16 has a section nearly parallel with the face of the metal strip, and is positioned at the place where the support rolls are located in a conventional apparatus. With that type of streaming plate 16, the dross adhesion is more surely prevented.

The above-described method eliminates all the submersed support rolls from the molten metal bath. Nevertheless, the correction of warp and the suppression of vibration can be more effectively conducted by leaving one submersed support roll and by letting the metal strip contact to the submersed support roll after being turned its running direction by the sink roll. This method, however, is more ineffective than the case of removing all the submersed support rolls in terms of improvement of productivity and of prevention of dross adhesion.

EXAMPLE 1

Figure 15:
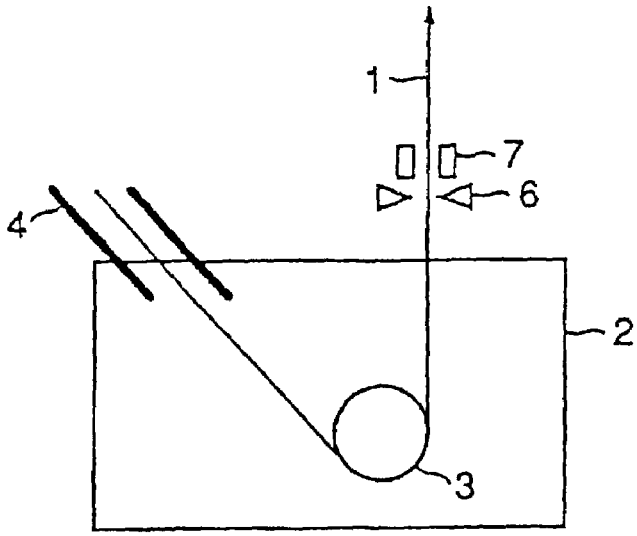
FIG. 15 illustrates an example of apparatus for manufacturing a hot-dip plated metal strip according to the present invention.

FIG. 15 illustrates an example of apparatus for manufacturing a hot-dip plated metal strip according to the present invention.

The metal strip 1 is introduced into the molten metal bath 2 via the snout 4 kept in a non-oxidizing atmosphere, turned the running direction by the sink roll 3, and then taken out upward from the molten metal bath 2. The plating weight of the molten metal as the plating metal adhered to the metal strip 1 during the travel through the molten metal bath 2 is adjusted by the gas wiper 6.

In the apparatus, no support roll which was adopted in a conventional apparatus exists in the molten metal bath 2. Instead of the support rolls, the control unit 7 for controlling the shape and the vibration of the metal strip utilizing magnetic force is positioned directly after the gas wiper 6 in a state of non-contact with the metal strip 1. The term "directly after the gas wiper 6" referred herein means a position between the gas wiper 6 and the alloying furnace which is described later. The control unit 7 for controlling the shape and the vibration of the metal strip can perform better shape control if the unit 7 is positioned as close to the gas wiper 6 as possible.

The control unit 7 for controlling the shape and the vibration of the metal strip using magnetic force may allow the control method for the shape and the vibration of metal strip using electromagnets, shown in FIG. 7.

EXAMPLE 2

Figure 16:
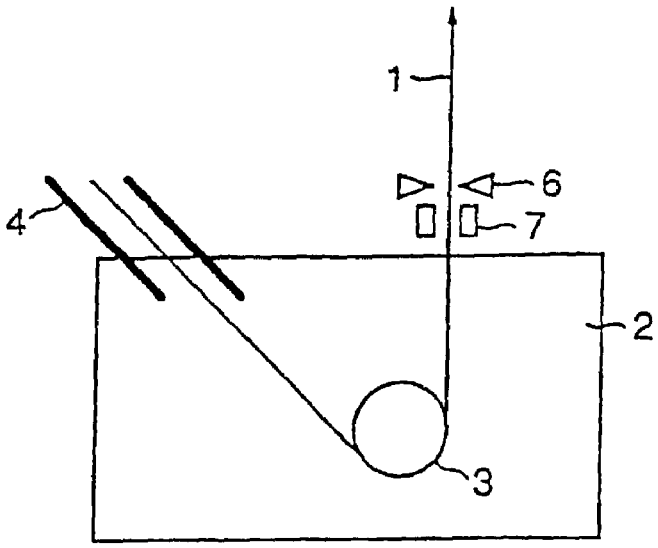
FIG. 16 illustrates another example of apparatus for manufacturing a hot-dip plated metal strip according to the present invention.

FIG. 16 illustrates another example of apparatus for manufacturing a hot-dip plated metal strip according to the present invention.

In this apparatus, the control unit 7 for controlling the shape and the vibration of the metal strip using magnetic force, given in FIG. 15, is positioned directly before the gas wiper 6 in a state of non-contact with the metal strip 1. The term "directly before the gas wiper 6" referred herein means a position between the molten metal bath 2 and the gas wiper 6. The control unit 7 for controlling the shape and the vibration of the metal strip can perform better shape control if the unit 7 is positioned as close to the gas wiper 6 as possible.

The control unit 7 for controlling the shape and the vibration of the metal strip provides the same effect in either case that the unit 7 is positioned directly before or that the unit 7 is positioned directly after the gas wiper 6. However, the position of directly before the gas wiper 6 and the position directly after the gas wiper 6 have respective advantages described below.

Directly before the gas wiper: Since nothing that disturbs the gas flow exists directly after the gas wiper 6, no quality degradation occurs.

Directly after the gas wiper: No trouble occurs on the control unit caused by adhesion of molten metal that is removed from the metal strip by gas wiping action.

Accordingly, the positioning of the control unit 7 for controlling the shape and the vibration of the metal strip may be selected taking into account of the advantages of each method and of the conditions of manufacturing line such as a space.

EXAMPLE 3

Figure 17A:
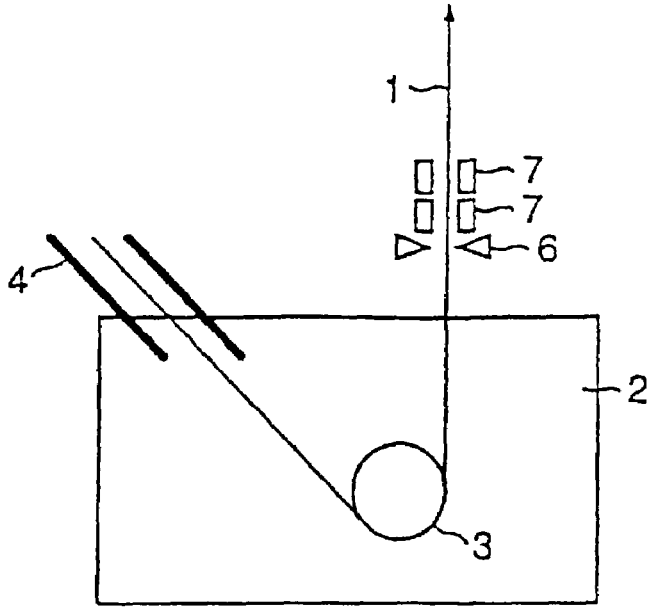
FIG. 17A and FIG. 17B illustrate further example of apparatus for manufacturing a hot-dip plated metal strip according to the present invention.
Figure 17B:
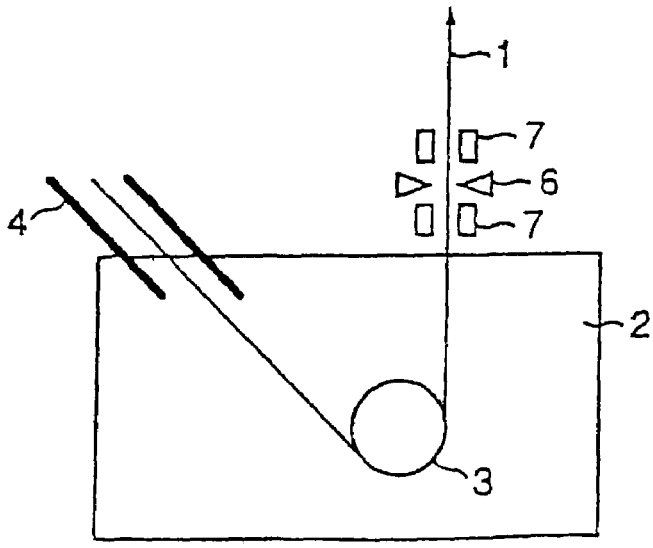

FIG. 17A and FIG. 17B illustrate further example of apparatus for manufacturing a hot-dip plated metal strip according to the present invention.

In this apparatus, two control units 7 for controlling the shape and the vibration of the metal strip using magnetic force are positioned at directly after the gas wiper 6 or at directly before and after the gas wiper 6 in a state of non-contact with the metal strip 1.

With the plurality of control units 7 for controlling the shape and the vibration of the metal strip, the shape correction or the vibration suppression is more effectively conducted.

Generally for the shape correction, since the change in shape such as warp occurs slowly, the control system of the control unit 7 for controlling the shape and the vibration of the metal strip is not strongly requested to have followability. On the other hand, for the vibration suppression, the variation of metal strip 1 occurs quickly so that the control system of the control unit 7 for controlling the shape and the vibration of the metal strip is requested to have quick response ability. Regarding the force required for the actuator, the shape correction requires significantly strong force depending on the thickness and the tension of the metal strip 1, while the vibration suppression often requires only a force that can suppress resonance of the metal strip 1. Accordingly, if, for example, the actuator is an electromagnet, the number of coil windings, the core shape, and other characteristics should be changed depending on the shape correction service or on the vibration suppression service.

Consequently, it is effective that plurality of control units 7 is adopted and that work allotment is given to each control unit 7 to perform mainly the shape correction and to perform mainly the vibration suppression.

EXAMPLE 4

Figure 18:
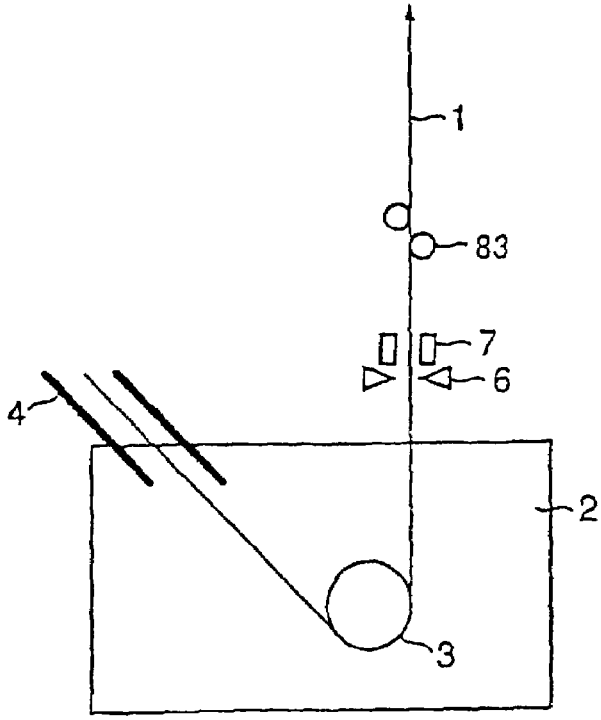
FIG. 18 illustrates still another example of apparatus for manufacturing a hot-dip plated metal strip according to the present invention.

FIG. 18 illustrates still another example of apparatus for manufacturing a hot-dip plated metal strip according to the present invention.

In the apparatus, the support rolls 83 outside the bath to hold the metal strip 1 from two sides are positioned directly after the control unit 7 for controlling the shape and the vibration of the metal strip using magnetic force shown in FIG. 15.

The support rolls 83 outside the bath are generally used to stabilize the running of the metal strip 1 when is produced the high grade hot-dip plated metal strip to be applied to, for example, external panels of automobiles. Consequently, since the present invention suppresses the vibration of metal strip 1 using the support rolls 83 outside the bath, the control unit 7 controlling the shape and the vibration of the metal strip mainly conducts the shape correction. Even when accidentally large vibration is generated, the support rolls 83 outside the bath can prevent the influence of the vibration so that further stable operation is attained.

It is not preferable that the support rolls 83 outside the bath are positioned directly after wiping action in contact with the metal strip 1. Nevertheless, when succeeding alloying treatment is given in such a case of manufacturing a high grade hot-dip plated metal strip, the contact with the support rolls 83 outside the bath raises very little problem.

When the direction of force applied from the metal strip 1 to the support rolls 83 outside the bath is considered, a single support roll 83 outside the bath may be located at one side of the metal strip 1. That is, if the control unit 7 for controlling the shape and the vibration of the metal strip 1 applies a force to the metal strip 1 to keep pressing thereof against a single support roll 83 outside the bath, the contact point between the support roll 83 outside the bath and the metal strip 1 creates a node of vibration, so that the vibration of the metal strip 1 can be suppressed.

EXAMPLE 5

Figure 19:
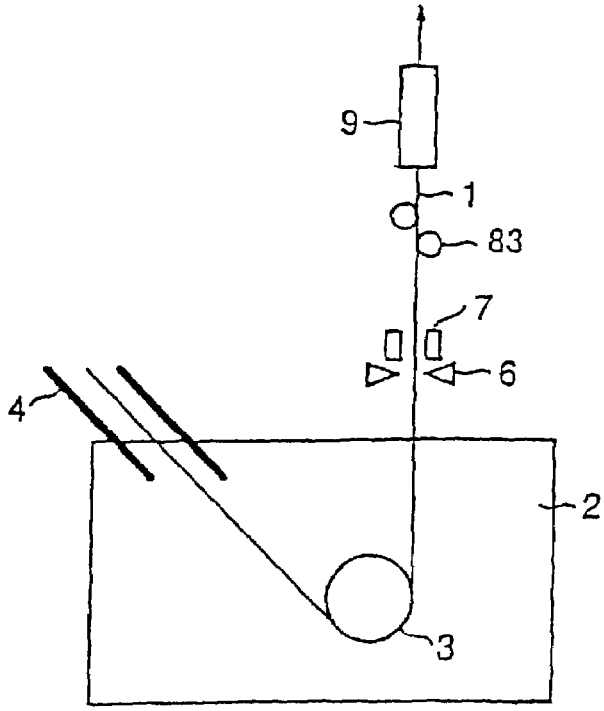
FIG. 19 illustrates still further example of apparatus for manufacturing a hot-dip plated metal strip according to the present invention.

FIG. 19 illustrates still further example of apparatus for manufacturing a hot-dip plated metal strip according to the present invention.

In the apparatus, the alloying furnace 9 is located after the support rolls 83 shown in FIG. 18.

As described above, the alloying furnace 9 eliminates the effect of the contact between the support rolls 83 and the metal strip 1.

EXAMPLE 6

Figure 20:
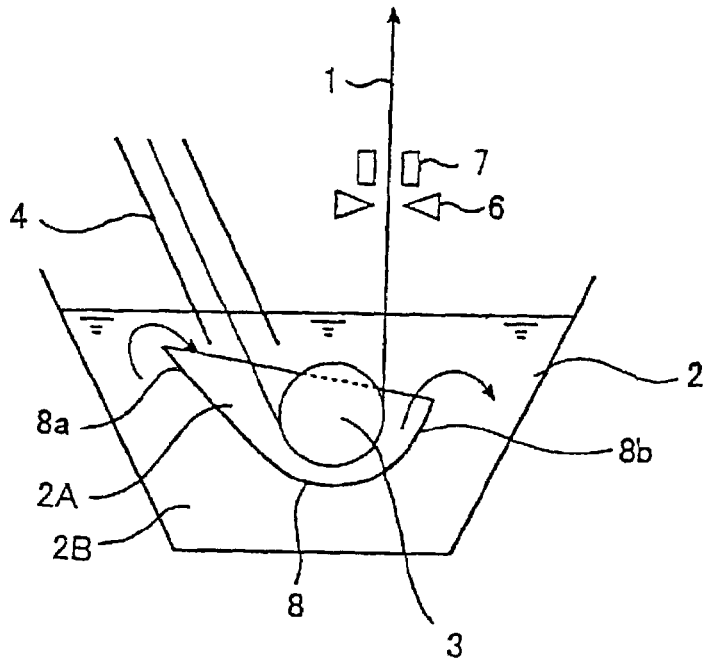
FIG. 20 illustrates an example of apparatus for manufacturing a hot-dip plated metal strip, provided with an open top enclosure, according to the present invention.

An apparatus for manufacturing a hot-dip plated metal strip having an open top enclosure as an example of the present invention, shown in FIG. 20, was used to manufacture a hot-dip galvanized steel strip 1 by continuously adhering molten zinc onto the steel strip 1 having 1,200 mm in width and 1.0 mm in thickness at a running speed of 90 mpm and a tension of 2 kg/cm$^2$, and adjusting the plating weight per side of the steel strip to 45 g/m$^2$ using the gas wiper 6.

The applied sink roll 3 had a diameter of 800 mm, and the distance between the top of the sink roll 3 and the level of the molten zinc bath 2 was about 600 mm. The open top enclosure 8 was located beneath the sink roll 3 to enclose the sink roll 3, thus separating the molten zinc bath 2 to upper section and lower section. The minimum distance between the open top enclosure 8 and the steel strip 1 was 150 mm.

Directly after the gas wiper 6 and at a distance of 1 to 20 m from the steel strip 1, there was located a control unit 7 for controlling the shape and the vibration of the steel strip 1, having electromagnets 13, which apply magnetic force to the steel strip 1, at three positions in the width direction of the steel strip 1 so as to correct the warp of the steel strip 1 near the gas wiper 6.

A sample having a size of 300 mm square was cut from the hot-dip galvanized steel strip 1 to observe the surface thereof. No dross was found on the sample. The deviation in plating weight along the width of the steel strip 1 was determined to about±5 g/m$^2$.

Similar test was conducted using the apparatus having no open top enclosure 8, and ten positions of dross were found on a 300 mm square sample. The deviation in plating weight along the width of the steel strip 1 was determined to about ±5 g/m$^2$.

For comparison, an apparatus having conventional molten metal bath shown in FIG. 2 was used to conduct similar tests. Twenty positions of dross were found on a 300 mm square sample. The deviation in plating weight along the width of the steel strip 1 was determined to about ±10 g/m$^2$.

EXAMPLE 7

The apparatus for manufacturing a hot-dip plated metal strip, shown in FIG. 20, was used to manufacture a hot-dip galvanized steel strip 1 by continuously adhering molten zinc onto the steel strip 1 having 1,200 mm in width and 1.0 mm in thickness at a running speed of 90 mpm and a tension of 2 kg/cm$^2$, and adjusting the plating weight per side of the steel strip to 45 g/m$^2$ using the gas wiper 6.

The applied sink roll 3 had a diameter of 950 mm, and the distance between the top of the sink roll 3 and the level of the molten zinc bath 2 was about 200 mm. The minimum distance between the open top enclosure 8 and the steel strip 1 was 100 mm.

The test similar to that of Example 6 was given to the steel strip 1. No dross was found on the sample having a size of 300 mm square. The deviation in plating weight along the width of the steel strip 1 was determined to about ±5 g/m$^2$.

Similar test was conducted with the apparatus having no open top enclosure 8, and fourteen positions of dross were found on a 300 mm square sample. The deviation in plating weight along the width of the steel strip 1 was determined to about ±4 g/m$^2$.

For comparison, an apparatus having conventional molten metal bath shown in FIG. 2 was used to conduct similar test. Seventeen positions of dross were found on a 300 mm square sample. The deviation in plating weight along the width of the steel strip 1 was determined to about ±10 g/m$^2$.

EXAMPLE 8

Figure 21:
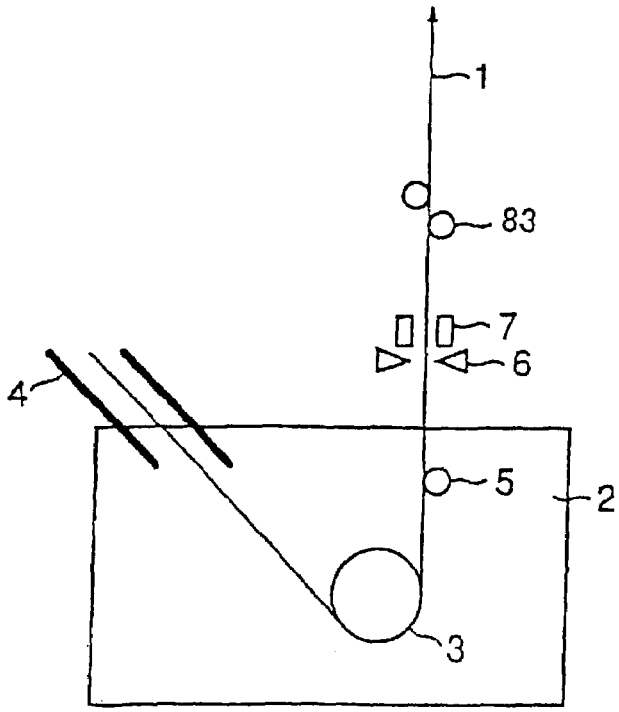
FIG. 21 illustrates another example of apparatus for manufacturing a hot-dip plated metal strip according to the present invention.

FIG. 21 illustrates still other example of apparatus for manufacturing a hot-dip plated metal strip according to the present invention.

The apparatus corresponds to the apparatus shown in FIG. 18, which further contains one submersed support roll 5 in the bath in addition to the support rolls 83 to press the metal strip 1 from two sides after the control unit 7 for controlling the shape and the vibration of the metal strip in non-contact state.

Figure 22A:
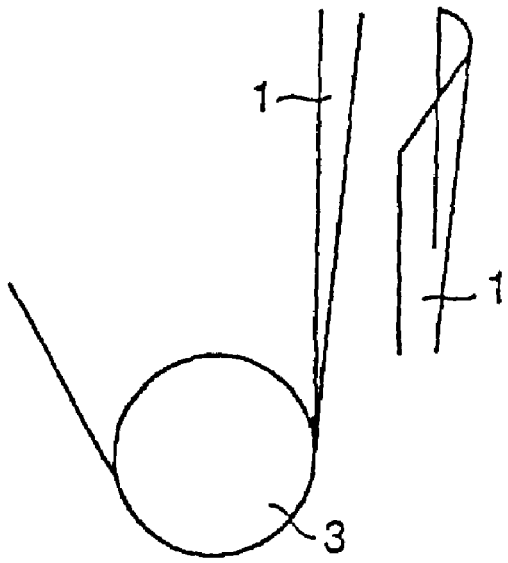
FIG. 22A and FIG. 22B show the relationship between the distance at the moment that the metal strip leaves the sink roll and the warp of the metal strip.
Figure 22B:
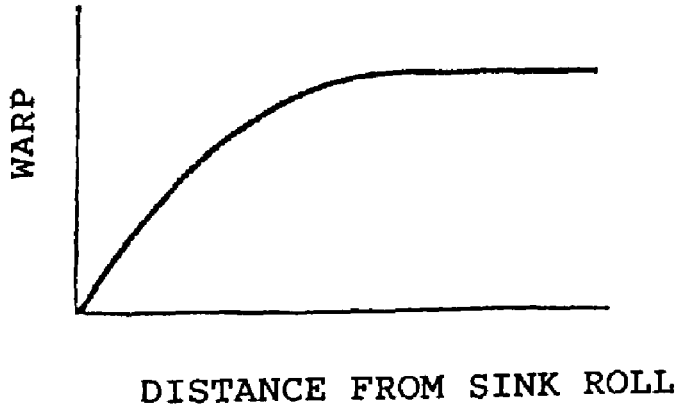

As shown in FIG. 22A and FIG. 22B, the warp in width direction of the steel strip 1 generated by plastic deformation thereof caused by the sink roll 3 increases in the magnitude of convexity with an increase in the distance from the sink roll 3, and becomes a constant magnitude at a certain distance. Accordingly, if no submersed support roll 5 exists, the distance between the sink roll 3 to which the metal strip 1 is not restricted and the gas wiper 6 becomes longer than the distance between the sink roll 3 to which the metal strip 1 is not restricted and the gas wiper 6 in the case of existence of the submersed support roll 5. Consequently, the warp of the metal strip becomes large, which requires to increase the correction force necessary to flatten the metal strip 1 at the position of the gas wiper 6.

Therefore, it is possible to minimize the correction force (for example, supply current for the case of electromagnet) necessary to flatten the metal strip 1 at the position of the gas wiper 6 by installing a single submersed support roll 5 in the bath to press thereof against the metal strip 1 to apparently eliminate the warp.

Furthermore, since there is only one submersed support roll, there are few differences from the conventional method, thus the present invention can be applied without significantly changing the conventional operational conditions. Consequently, the example is the first step for moving to the case without using submersed support roll.

The submersed support roll 5 is not limited to the position given in FIG. 21, and may be positioned so as to contact with the surface of the metal strip 1 at the sink roll 3 side. Also for the case of applying submersed support roll 5, variations of auxiliary units shown in FIGS. 16 through 19 may be applied.

What is claimed is:

1. A method for manufacturing a hot-dip plated metal strip comprising:

introducing a metal strip into a molten metal bath of plating metal to adhere the molten metal onto a surface of the metal strip;

turning a running direction of the metal strip and then taking the metal strip out from the molten metal bath without applying external force from outside the surface of the metal strip;

adjusting a plating weight of the molten metal adhered onto the metal strip; and controlling a shape of the metal strip using magnetic force in a non-contact state directly before or after adjusting the plating weight.

2. The method of claim 1, further comprising simultaneously conducting vibration control of the metal strip with the use of magnetic force to control the shape of the metal strip.

3. The method of claim 1, further comprising controlling vibration of the metal strip after adjusting the plating weight of the molten metal by contacting at least one roll thereto.

4. A method for manufacturing a hot-dip plated metal strip comprising:

introducing a metal strip into a molten metal bath of plating metal to adhere the molten metal onto a surface of the metal strip;

turning a running direction of the metal strip and then taking the metal strip out from the molten metal bath without applying external force from outside the surface of the metal strip;

adjusting a plating weight of the molten metal adhered onto the metal strip;

controlling a shape of the metal strip using magnetic force in a non-contact state directly before or after adjusting the plating weight;

controlling vibration of the metal strip by contacting at least one roll thereto; and alloying the metal strip after controlling the vibration of the metal strip.

5. A method for manufacturing a hot-dip plated metal strip comprising:

introducing a metal strip into a molten metal bath of plating metal to adhere the molten metal onto a surface of the metal strip;

turning a running direction of the metal strip using a sink roll and then taking the metal strip out from the molten metal bath;

adjusting a plating weight of the molten metal adhered onto the metal strip; and controlling a shape of the metal strip using magnetic force in a non-contact state directly before or after adjusting the plating weight, wherein the metal strip is only roll-contacted by the sink roll in the molten metal bath.

6. A method for manufacturing a hot-dip plated metal strip comprising:

introducing a metal strip into a molten metal bath of plating metal to adhere the molten metal onto a surface of the metal strip;

turning a running direction of the metal strip using a sink roll and then taking the metal strip out from the molten metal bath;

adjusting a plating weight of the molten metal adhered onto the metal strip;

controlling a shape of the metal strip using magnetic force in a non-contact state directly before or after adjusting the plating weight;

controlling vibration of the metal strip after adjusting the plating weight of the molten metal by contacting at least one roll thereto; and alloying the metal strip after controlling the vibration of the metal strip, wherein the metal strip is only roll-contacted by the sink roll in the molten metal bath.

7. The method of claim 5, wherein the sink roll has a diameter of at least 600 mm.

8. The method of claim 5, wherein the sink roll has a diameter of at least 850 mm.

9. The method of claim 5, wherein the sink roll is positioned to keep distances of from 50 to 400 mm between an upper end of the sink roll and a level of the molten metal bath.

10. The method of claim 5, wherein the sink roll is positioned to keep distances of at least 400 mm between a lower end of the sink roll and a bottom of the molten metal bath.

11. The method of claim 5, wherein the sink roll is positioned to keep distances of at least 700 mm between a lower end of the sink roll and a bottom of the molten metal bath.

12. The method of claim 5, wherein the molten metal bath is separated into upper and lower sections using an open top enclosure enclosing the sink roll from below while allowing the molten metal to flow therebetween.

13. The method of claim 12, wherein the molten metal above the open top enclosure flows downward from a side of the metal strip when the metal strip is taken out from the molten metal bath to beneath the open top enclosure, and the molten metal beneath the open top enclosure flows upward from the side of the metal strip when the metal strip is introduced into the molten metal bath to above the open top enclosure, thus creating a circulation flow of the molten metal.

14. The method of claim 12, wherein the open top enclosure is positioned below a level of the molten metal bath.

15. The method of claim 12, wherein a minimum distance between the sink roll and the open top enclosure is in a range of from 50 to 400 mm.

16. The method of claim 12, wherein the sink roll is positioned to keep distances of from 50 to 400 mm between an upper end of the sink roll and a level of the molten metal bath.

17. The method of claim 12, wherein the sink roll is positioned to keep distances of at least 400 mm between a lower end of the sink roll and a bottom of the molten metal bath.

18. The method of claim 12, wherein the sink roll has a diameter of at least 850 mm.

* * * * *